US010181292B2

(12) United States Patent
Jung et al.

(10) Patent No.: US 10,181,292 B2
(45) Date of Patent: Jan. 15, 2019

(54) COMPENSATION MARGIN CONTROL DEVICE, ORGANIC LIGHT EMITTING DISPLAY DEVICE, AND METHOD OF DRIVING THE SAME

(71) Applicant: LG Display Co., Ltd., Seoul (KR)

(72) Inventors: Kimoon Jung, Paju-si (KR); ChongHun Park, Paju-si (KR); Geondo Park, Seoul (KR)

(73) Assignee: LG Display Co., Ltd., Seoul (KR)

( * ) Notice: Subject to any disclaimer, the term of this patent is extended or adjusted under 35 U.S.C. 154(b) by 38 days.

(21) Appl. No.: 15/250,453

(22) Filed: Aug. 29, 2016

(65) Prior Publication Data

US 2017/0061892 A1 Mar. 2, 2017

(30) Foreign Application Priority Data

Aug. 31, 2015 (KR) ..... 10-2015-0123149

(51) Int. Cl.
*G09G 3/3291* (2016.01)
*G09G 3/3233* (2016.01)

(52) U.S. Cl.
CPC ..... *G09G 3/3291* (2013.01); *G09G 3/3233* (2013.01); *G09G 2300/043* (2013.01); *G09G 2300/0426* (2013.01); *G09G 2300/0452* (2013.01); *G09G 2300/0819* (2013.01); *G09G 2320/0271* (2013.01); *G09G 2320/0295* (2013.01); *G09G 2320/045* (2013.01)

(58) Field of Classification Search
CPC ..... G09G 3/3233; G09G 3/3258; G09G 2320/0295; G09G 2320/043; G09G 2320/0233; G09G 3/30; G09G 2300/0439; G09G 2300/0819
USPC ..... 345/76
See application file for complete search history.

(56) References Cited

U.S. PATENT DOCUMENTS

2008/0094320 A1* 4/2008 Parikh ..... G09G 3/3233 345/76
2009/0140959 A1* 6/2009 Nam ..... G09G 3/3233 345/76
2011/0210958 A1* 9/2011 Yoo ..... G09G 3/325 345/214
2012/0299978 A1* 11/2012 Chaji ..... G09G 3/3291 345/690
2013/0050292 A1* 2/2013 Mizukoshi ..... G09G 3/3291 345/690
2013/0083001 A1* 4/2013 Jeong ..... G09G 3/3233 345/212
2013/0100173 A1* 4/2013 Chaji ..... G09G 5/10 345/690
2014/0176617 A1* 6/2014 Jeong ..... G09G 3/2003 345/690
2014/0176625 A1* 6/2014 Yoon ..... G09G 3/3233 345/691

* cited by examiner

*Primary Examiner* — Koosha Sharifi-Tafreshi
(74) *Attorney, Agent, or Firm* — Polsinelli PC

(57) ABSTRACT

A compensation margin control device, an organic light emitting display device, and a driving method thereof according to the present disclosure provide an effect to improve the image quality by ensuring a margin of a negative bios shift compensation region of a driving transistor of a non-driven sub-pixel without affecting a gray level representation and positive compensation.

14 Claims, 11 Drawing Sheets

COMPENSATION MARGIN CONTROL DEVICE, ORGANIC LIGHT EMITTING DISPLAY DEVICE, AND METHOD OF DRIVING THE SAME

CROSS REFERENCE TO RELATED APPLICATION

This application claims priority from Korean Patent Application No. 10-2015-0123149 filed in the Republic of Korea on Aug. 31, 2015, which is hereby incorporated by reference for its entirety.

BACKGROUND

Field of the Disclosure

The present disclosure relates to a display device, and more particularly to an organic light emitting displace device and method of driving the same. Although the present disclosure is suitable for a wide scope of applications, it is particularly suitable for improving image quality by properly compensating a unique characteristic value among driving transistors of the organic light emitting display device.

Description of the Background

Recently, an organic light emitting display device has been in the spotlight as a display device because it has the advantages of the high response speed, high contrast ratio, high luminous efficiency, high luminance, and large viewing angle by using organic light emitting diode (OLED) that emits light by itself.

Each sub-pixel arranged on a display panel of the organic light emitting display device, basically, is configured to include an organic light emitting diode (OLED) and a driving transistor for driving the same.

The organic light emitting display device controls the brightness of the organic light emitting diode (OLED) with a drive current of the driving transistor, which is determined on the basis of a data voltage output from a data driver, and displays an image.

Meanwhile, the driving transistor in each sub-pixel on the display panel has a unique characteristic value such as a threshold voltage, mobility, or the like. As the driving time increases, the drive transistor becomes degraded and the unique characteristic value of the driving transistor varies.

The degradation of the driving transistor generates a deviation of the unique characteristic value of the driving transistors of each sub-pixel, and causes a luminance deviation between the sub-pixels, and thus degrade the image quality.

In accordance with this, a technology to compensate for the luminance deviation between the sub-pixels (that is, a technology to compensate the unique characteristic value deviation between the driving transistors) has been proposed.

Despite the compensation technology has been proposed, there is still a problem in that the unique characteristic value deviation between the driving transistors cannot be compensated for any reasons.

In addition, despite the unique characteristic value deviation between the driving transistors having been compensated by the compensation technology, there is still a problem in that the image quality cannot be improved and can even be lowered.

SUMMARY

In this background, an aspect of the present disclosure is to provide a compensation margin control device, an organic light emitting display device and a method of driving the same, which can effectively perform compensation associated with a unique characteristic value of a driving transistor, thereby improving the image quality.

Also, another aspect of the present disclosure is to provide a compensation margin control device, an organic light emitting display device and a method of driving the same, which can improve the image quality by ensuring a margin of a negative bios shift compensation region of the driving transistor of a non-driven sub-pixel, without affecting the gray level representation and positive compensation.

In addition, another aspect of the present disclosure is to provide a compensation margin control device, an organic light emitting display device and a method of driving the same, which can improve the image quality by allowing a compensation associated with the unique characteristic value of the driver transistor to be made, though the threshold voltage shift phenomenon of the driving transistor occurs.

In accordance with an aspect of the present disclosure, there is provided an organic light emitting display device. The organic light emitting display device includes: a display panel on which a plurality of data lines and a plurality of gate lines are arranged, and a plurality of sub-pixels are arranged in a matrix form; a data driver configured to drive the data lines; a gate driver configured to drive the gate lines; and a timing controller configured to control the data driver and the gate driver, each of the sub-pixels comprises an organic light emitting diode, a driving transistor, a first transistor, a second transistor, and a capacitor, each of the sub-pixels constitutes a pixel in four units, and driving voltages of a source driver integrated circuits included in the data driver are differently configured for a driven sub-pixel and non-driven sub-pixel, when the pixel is driven to represent a color, and has an effect to more effectively perform the compensation related to the unique characteristic value of the driving transistor, thereby improving the image quality.

In accordance with another aspect of the present disclosure, there is provided a method of driving an organic light emitting display device. The method of driving an organic light emitting display device, in which a plurality of sub-pixels configured to include an organic light emitting diode, a driving transistor having a first node electrically connected to a first electrode of the organic light emitting diode, a second node corresponding to a gate node, and a third node electrically connected to a driving voltage line, a first transistor connected between the first node of the driving transistor and a reference voltage line, a second transistor electrically connected between the second node of the driving transistor and a data line, and a storage capacitor electrically connected between the first node and second node of the driving transistor are arranged in a matrix form, includes: sensing a threshold voltage shift of the driving transistors in the plurality of sub-pixels; obtaining a sensing value in the sensing of the threshold voltage shift, and determining whether each sensing value is a sensing value of a driven sub-pixel or a sensing value of non-driven sub-pixel; configuring a first voltage driving value for the driven sub-pixel and a second voltage driving value for the non-driven sub-pixel; and performing data compensation on the basis of the first and second voltage driving values, and has an effect to improve the image quality by ensuring a margin of the negative bios shift compensation region of the driving transistor of the non-driven sub-pixel, without affecting the gray level representation and positive compensation.

In accordance with another aspect of the present disclosure, there is provided a compensation margin control device. The compensation margin control device includes: a sub-pixel driving verifying unit configured to verify whether a sensing value obtained from a display panel is a sensing value of a driven sub-pixel or a sensing value of a non-driven sub-pixel; a non-driven sub-pixel compensation margin control unit configured to control a compensation region margin for the non-driven sub-pixel; a driven sub-pixel compensation margin control unit configured to control a compensation region margin for the driven sub-pixel; and a command transfer unit configured to transfer compensation region margin information of the driven sub-pixel and non-driven sub-pixel, and has an effect to improve the image quality by allowing a compensation related to the unique characteristic value of the driving transistor to be made, though the threshold voltage shift phenomenon of the driving transistor occurs.

As described above, according to a compensation margin control device, an organic light emitting display device, and a method of driving the same of the present disclosure, there is an effect to effectively perform the compensation related to the unique characteristic value of the driving transistor, thereby improving the image quality.

Also, according to a compensation margin control device, an organic light emitting display device, and a method of driving the same of the present disclosure, there is an effect to improve the image quality by ensuring a margin of the negative bios shift compensation region of the driving transistor of the non-driven sub-pixel, without affecting the gray level representation and positive compensation.

Further, according to a compensation margin control device, an organic light emitting display device, and a method of driving the same of the present disclosure, though the threshold voltage shift phenomenon of the driving transistor occurs, there is an effect to improve the image quality by allowing a compensation related to the unique characteristic value of the driving transistor to be made.

BRIEF DESCRIPTION OF THE DRAWINGS

The above and other objects, features, and advantages of the present disclosure will be more apparent from the following detailed description taken in conjunction with the accompanying drawings, in which.

DETAILED DESCRIPTION

Figure 1:
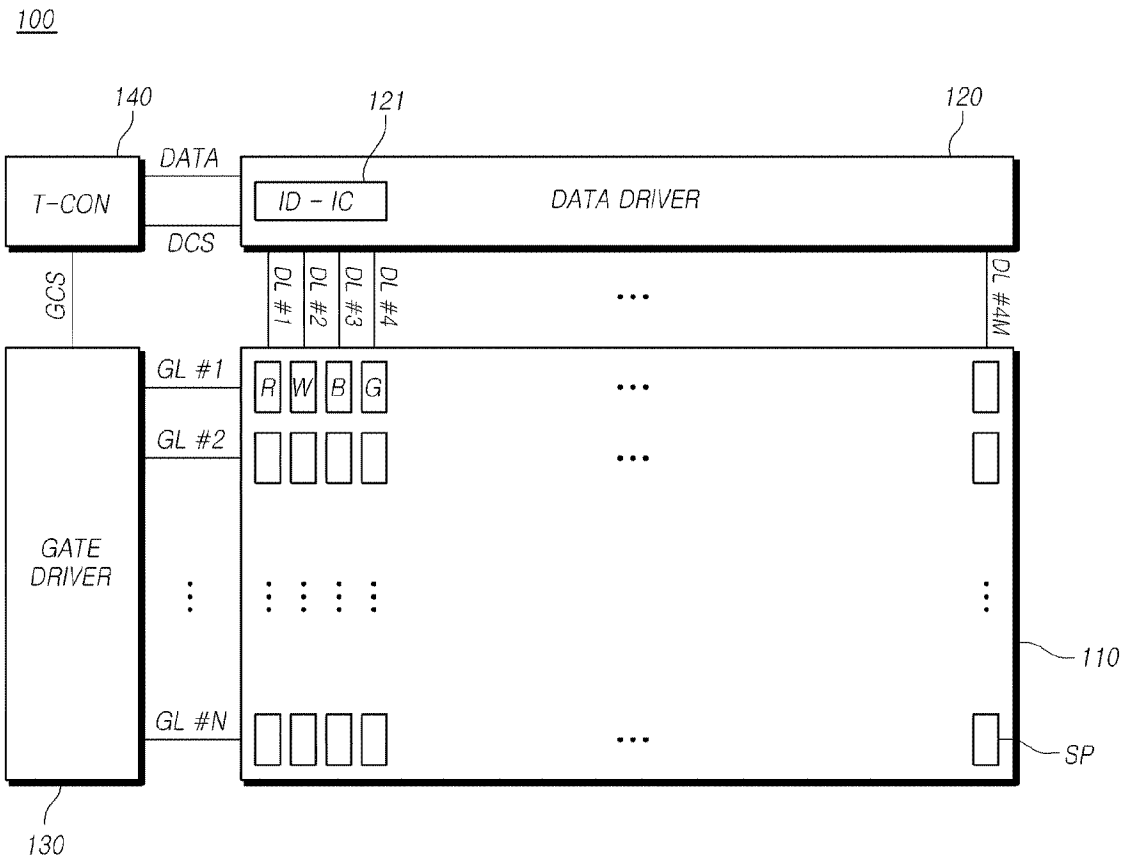
FIG. 1 is a view schematically illustrating a system configuration of an organic light emitting display device according to the present disclosure.

The advantages and features of the present disclosure and methods of achieving the same will be apparent by referring to embodiments of the present disclosure as described below in detail in conjunction with the accompanying drawings. However, the present disclosure is not limited to the embodiments set forth below, but may be implemented in various different forms. The following embodiments are provided only to completely disclose the present disclosure and inform those skilled in the art of the scope of the present disclosure, and the present disclosure is defined only by the scope of the appended claims.

The shapes, sizes, ratios, angles, numbers, and the like shown in the drawings for explaining embodiments of the present disclosure are illustrative, and therefore the present disclosure is not limited to the shown matters. Throughout the specification, the same or like reference numerals designate the same or like elements. Further, in the description of the present disclosure, when it is determined that the detailed description of the related well-known technologies unnecessarily make the subject matter of the present disclosure unclear, the detailed description will be omitted.

When the expression "include", "have", "comprise", or the like as mentioned herein is used, any other part may be added unless the expression "only" is used. When an element is expressed in the singular, the element covers the plural form unless a special mention is explicitly made of the element.

In an interpretation of the components, even if there is no separate expressive description, it should be construed to include a margin of error. If a description of a positional relationship, for example, when describing the positional relationship between two parts such as "on ~", "over ~", "below ~", "next ~" and "right ~", it may mean that one or more of another part may be located between the two parts unless the term "right" or "directly" is used.

If a description of a time relationship, (for example, the time ever sequencing relation) is described, such as "after", "then", "next", "ago", a non-contiguous case may be also included unless the term "right" or "directly" is used.

Although the terms "first" and "second" are used to describe various components, these components are not limited by these terms. These terms are used to merely distinguish one component from other components. Thus, a first component discussed below may be a second component within the scope of the invention.

Each feature of various embodiments of the present disclosure can be partially or fully coupled to, or combined with each other, and it is possible that various linkage and drive technically. Each of the embodiments may be performed independently with respect to each other and may be carried out together by affinity.

Hereinafter, exemplary embodiments of the present disclosure will be described in detail with reference to the accompanying drawings. In the drawings, the size, widths, and/or thickness of components may be slightly increased in order to clearly express the components of each device. In the following description, the same elements will be designated by the same reference numerals throughout the description.

FIG. 1 is a view schematically illustrating a system configuration of an organic light emitting display device according to the present disclosure.

Referring to FIG. 1, the organic light emitting display device 100 according to the present disclosure includes a plurality of data lines DL #1, DL #2, . . . , DL #4M (M is a natural number equal to or greater than 1) disposed in a first direction (for example, a column direction), a plurality of gate lines GL #1, GL #2, . . . , GL #N (N is a natural number equal to or greater than 1) disposed in a second direction (for example, a row direction), a display panel 110 in which a plurality of sub-pixels SP are arranged in a matrix form, a data driver 120 configured to drive the plurality of data lines DL #1, DL #2, . . . , DL #4M, a gate driver 130 configured to drive the plurality of gate lines GL #1, GL #2, . . . , GL #N, and a timing controller (T-CON) 140 configured to control the data driver 120 and the gate driver 130.

The data driver 120 supplies a data voltage to the plurality of data lines DL #1, DL #2, . . . , DL #4M to drive the plurality of data lines DL #1, DL #2, . . . , DL #4M.

The gate driver 130 sequentially supplies scan signals to the plurality of gate lines GL #1, GL #2, . . . , GL #N to sequentially drive the plurality of gate lines GL #1, GL #2, . . . , GL #N.

The timing controller 140 supplies a variety of control signals to the data driver 120 and gate driver 130 to control the data driver 120 and the gate driver 130, respectively.

The timing controller 140 starts to scan according to timing implemented in each frame, changes input image data input from outside into data matched to a data signal form used in the data driver 120 and outputs the changed image data DATA, and controls data driving at a proper time according to the scanning.

The gate driver 130 sequentially supplies scan signals of an on ON voltage or an off OFF voltage to the plurality of gate lines GL #1, GL #2, . . . , GL #N according to the control of the timing controller 140 to sequentially drive the plurality of gate lines GL #1, GL #2, . . . , GL #N.

The gate driver 130 may be located only on one side of the display panel 110, as shown in FIG. 1, and in some cases, it may be located on both sides of the display panel 110 depending upon the driving method.

In addition, the gate driver 130 may include one or more gate driver integrated circuits.

Each of the gate driver integrated circuits may be connected to a bonding pad of the display panel 110 by a tape automated bonding (TAB) method or a chip on glass (COG) method, or may be directly disposed on the display panel 110 by being implemented in a gate in panel (GIP) type, and in some cases, may be integrated and disposed in the display panel 110.

Each of the gate driver integrated circuits may include a shift register, a level shifter, or the like.

The data driver 120 changes image data DATA received from the timing controller 140 into a data voltage of an analog type, and supplies the data voltage to the plurality of data lines DL #1, DL #2, . . . , DL #4M to drive the plurality of data lines DL #1, DL #2, . . . , DL #4M, when a specific gate line is opened.

The data driver 120 may include at least one source driver integrated circuit (source D-IC) 121, and may drive the plurality of data lines DL #1, DL #2, . . . , DL #4M.

Each of the source driver integrated circuits 121 may be connected to the bonding pad of the display panel 110 by a tape automated bonding (TAB) method or a chip on glass (COG) method, or may be directly disposed on the display panel 110, and in some cases, may be integrated and disposed in the display panel 110.

Each of the source driver integrated circuits 121 may include a logic unit including a shift register, a latch circuit or the like, a digital to analog converter DAC, an output buffer or the like. In some cases, each of the source driver integrated circuits 121 may further include a sensing unit for sensing the characteristics of the sub-pixels to compensate the characteristics of the sub-pixels, such as, a threshold voltage and mobility of a driving transistor, a threshold voltage of an organic light emitting diode, a luminance of the sub-pixel, and the like.

Each of the source driver integrated circuits 121 may be implemented using a chip on film (COF) method. In this case, one end of each of the source driver integrated circuits 121 is bonded to at least one source printed circuit board and the other end is bonded to the display panel 110.

Meanwhile, the timing controller 140 receives, with input image data, a variety of timing signals including a vertical synchronizing signal Vsync, a horizontal synchronizing signal Hsync, an input data enable signal DE, a clock signal CLK, or the like from outside (for example, a host system).

The timing controller 140 changes input image data input from outside into data to be matched to a data signal form used in the data driver 120 and outputs the changed image data. In addition, the timing controller 140, in order to control the data driver 120 and gate driver 130, receives timing signals such as a vertical synchronizing signal Vsync, a horizontal synchronizing signal Hsync, an input data enable signal DE, and a clock signal CLK, generates a variety of control signals, and outputs the control signals to the data driver 120 and gate driver 130.

For example, the timing controller 140, in order to control the gate driver 130, outputs a variety of gate control signals (GCS) including a gate start pulse (GSP), a gate shift clock (GSC), a gate output enable signal (GOE), or the like.

Here, the gate start pulse (GSP) controls an operation start timing of one or more gate driver integrated circuits constituting the gate driver 130. The gate shift clock (GSC) is a clock signal commonly input to the one or more gate driver integrated circuits, and controls a shift timing of a scan signal (i.e., gate pulse). The gate output enable signal (GOE) assigns timing information of the one or more gate driver integrated circuits.

In addition, the timing controller 140, in order to control the data driver 120, outputs a variety of data control signals (DCS) including a source start pulse (SSP), a source sampling clock (SSC), a source output enable signal (SOE), or the like.

Here, the source start pulse (SSP) controls a data sampling start timing of the one or more source driver integrated circuits 121 constituting the data driver 120. The source sampling clock (SSC) is a clock signal controlling a sampling timing of data in each of the source driver integrated circuits 121. The source output enable signal (SOE) controls an output timing of the data driver 120.

Still referring to FIG. 1, the timing controller 140 may be disposed on a control printed circuit board connected to a source printed circuit board to which the source driver integrated circuit 121 is bonded, through a connecting medium such as a flexible flat cable, a flexible printed circuit board, and the like.

On the control printed circuit board, a power controller (not illustrated) for supplying various voltages or currents to the display panel 110, the data driver 120, and the gate driver 130, or controlling voltages or currents to be supplied may further be disposed. The power controller may also be referred to as a "power management IC".

The above-described source printed circuit board and the control printed circuit board may be formed in one printed circuit board.

In the organic light emitting display device 100 according to the present disclosure, each of the sub-pixels SP disposed on the display panel 110 may be composed of circuit elements, such as an organic light emitting diode (OLED), two or more transistors, at least one capacitor, and the like.

Type and the number of the circuit elements constituting each sub-pixel may be variously defined depending on a providing function, a design method, or the like.

Each sub-pixel of the display panel 110 according to the present disclosure may be configured as a circuit structure for compensating a sub-pixel characteristic value such as characteristic value (for example, a threshold voltage or the like) of an organic light emitting diode (OLED), characteristic value (for example, a threshold voltage, a mobility or the like) of a driving transistor for driving the organic light emitting diode (OLED), or the like.

Figure 2:
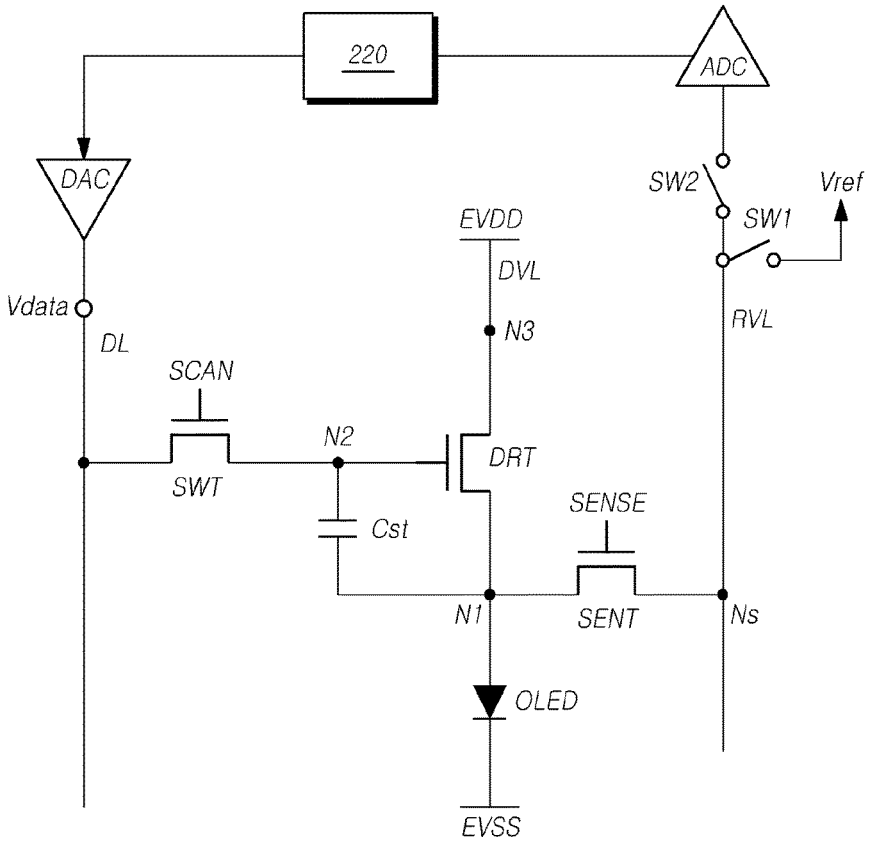
FIG. 2 is an exemplary circuit diagram illustrating a sub-pixel circuit of an organic light emitting display device according to the present disclosure.
Figure 3:
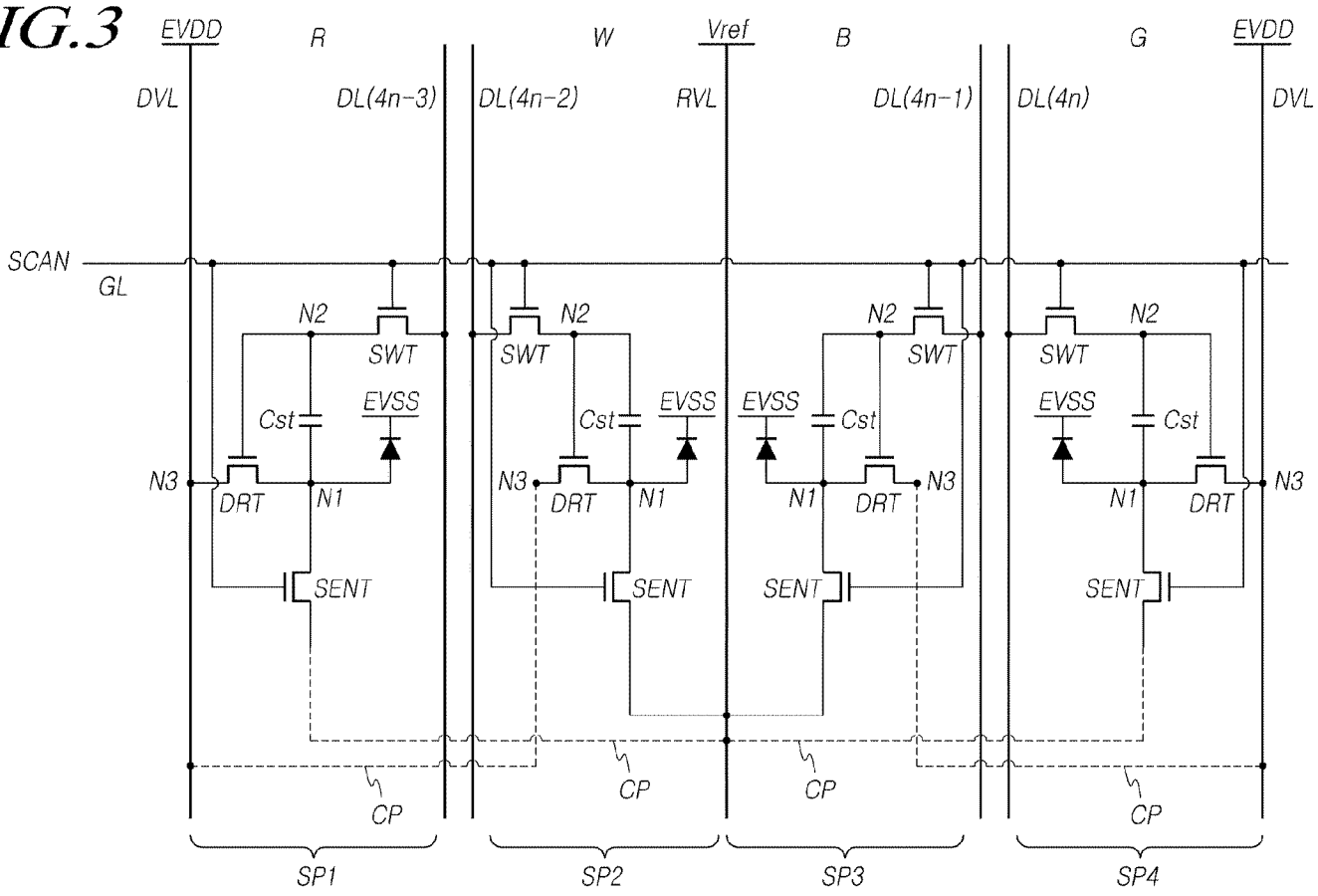
FIG. 3 is an exemplary view illustrating a sub-pixel circuit and a compensation structure of an organic light emitting display device according to the present disclosure.

FIG. 2 is an exemplary circuit diagram illustrating a sub-pixel circuit of an organic light emitting display device according to the present disclosure. FIG. 3 is an exemplary view illustrating a sub-pixel circuit and a compensation structure of an organic light emitting display device according to the present disclosure.

Referring to both FIGS. 2 and 3, each sub-pixel of the organic light emitting display device 100 according to the present disclosure is composed of an organic light emitting diode (OLED) and a driving circuit.

Referring to FIG. 2, the driving circuit in the sub-pixel having a compensation structure may be composed of, for example, three transistors (a driving transistor DRT, a switching transistor SWT, and a sensing transistor SENT), and a capacitor (a storage capacitor Cst)

As such, the sub-pixel configured to include three transistors DRT, SWT, SENT and one capacitor Cst is referred to as "a sub-pixel having a 3T1C structure".

Referring to FIG. 2, the organic light emitting diode (OLED) is composed of a first electrode (for example, an anode electrode or a cathode electrode), an organic layer, and a second electrode (for example, a cathode electrode or an anode electrode).

For example, in the organic light emitting diode (OLED), a source node or a drain node of the driving transistor DRT may be connected to the first electrode, and a ground voltage EVSS may be applied to the second electrode.

Referring to FIG. 2, the driving transistor DRT is a transistor that supplies a drive current to the organic light emitting diode (OLED), and drives the organic light emitting diode (OLED).

The driving transistor DRT has a first node N1 corresponding to a source node or a drain node, a second node N2 corresponding to a gate node, and a third node N3 corresponding to a drain node or a source node. Accordingly, hereinafter, for the convenience of description, the N1 node may be referred to as "source node", the N2 node may be referred to as "gate node", and the N3 node may be referred to as "drain node".

For example, in the driving transistor DRT, the N1 node may be electrically connected to the first electrode or the second electrode of the organic light emitting diode (OLED), and the N3 node may be electrically connected to a driving voltage line DVL providing a driving voltage EVDD.

Referring to FIG. 2, the switching transistor SWT is a transistor for transferring a data voltage Vdata to the N2 node corresponding to the gate node of the driving transistor DRT.

The switching transistor SWT is controlled by a scan control signal SCAN applied to the gate node, and is electrically connected between the N2 node of the driving transistor DRT and the data line DL.

Referring to FIG. 2, the storage capacitor Cst may be electrically connected between the N1 node and N2 node of the driving transistor DRT. A voltage between the N1 node and N2 node of the driving transistor DRT may be referred to as "Vgs voltage".

The storage capacitor Cst serves to maintain a constant voltage during one frame time.

Meanwhile, referring to FIG. 2, the sensing transistor SENT, which is added to the basic sub-pixel structure of FIG. 1, may be controlled by a sensing signal SENSE which is a kind of a scan signal applied to the gate node, and may be electrically connected between a reference voltage line RVL and the N1 node of the driving transistor DRT.

The sensing transistor SENT is turned on and may apply a reference voltage Vref provided through a sensing node Ns connected to the reference voltage line RVL to the N1 node (for example, a source node or a drain node) of the driving transistor DRT.

In addition, the sensing transistor SENT serves to enable a voltage of the N1 node of the driving transistor DRT to be sensed by an analog to digital converter ADC electrically connected to the reference voltage line RVL.

The roles of the sensing transistor SENT relate to a compensation function for a unique characteristic value of the driving transistor DRT. Here, the unique characteristic value of the driving transistor DRT may include, for example, a threshold voltage Vth, mobility or the like.

In this regard, when a deviation of the unique characteristic value (for example, threshold voltage, mobility) between the driving transistors DRTs in each sub-pixel occurs, luminance deviation between the sub-pixels may occur and cause the degradation of the image quality.

Accordingly, the luminance uniformity can be improved by sensing the unique characteristic value (for example, threshold voltage, mobility) of the driving transistors DRTs in the sub-pixels and compensating the unique characteristic value (threshold voltage, mobility) between the driving transistors DRT.

A principle of threshold voltage sensing of the driving transistor DRT will be briefly described. The threshold voltage sensing is made by making a voltage Vs of the source node N1 of the driving transistor DRT perform a source following operation that a voltage Vs of the source node N1 of the driving transistor DRT follows a voltage Vg of the gate node N2 and, after the voltage of the source node N1 of the driving transistor DRT is saturated, the voltage of the source node N1 of the driving transistor DRT is sensed as a sensing voltage.

At this time, the threshold voltage variation of the driving transistors DRTs can be determined on the basis of the sensed sensing voltage.

Next, a principle of the mobility sensing for the driving transistor DRT will be briefly described. In order to define the current capability characteristic of the driving transistor DRT other than the threshold voltage Vth of the driving transistor DRT, a predetermined voltage is applied to the gate node N2 of the driving transistor DRT.

In this way, the current capability (i.e., mobility) of the driving transistor DRT can be relatively determined through the amount of a voltage charged for a predetermined time, and through this, a correction gain (Gain) for compensation can be obtained.

The above-described mobility compensation through the mobility sensing may be performed by taking a predetermined time period when driving a screen. In this way, parameters of the driving transistor DRT, which vary in real time can be sensed and compensated.

Meanwhile, the gate node of the switching transistor SWT and the gate node of the sensing transistor SENT may be electrically connected to an identical gate line.

In other words, the gate node of the switching transistor SWT and the gate node of the sensing transistor SENT receive gate signals SCAN, SENSE in common through an identical gate line GL. At this time, the scan signal SCAN and the sense signal SENSE are the identical gate signals.

The gate node of the switching transistor SWT and the gate node of the sensing transistor SENT may be electrically connected to different gate lines, and the scan signal SCAN and the sense signal SENSE may be separately applied.

Referring to FIG. 2, the organic light emitting display device 100 may further include an analog to digital converter ADC configured to sense a voltage of the reference voltage line RVL, convert the sensed voltage into a digital value, generate sensing data, and transmit the generated sensing data to the timing controller 140.

Using the analog to digital converter ADC, the timing controller 140 can calculate a digital-based compensation value and perform data compensation.

The analog to digital converter ADC may be included in each source driver integrated circuit (D-IC) 121 with a digital to analog converter DAC converting image data to a data voltage Vdata.

Referring to FIG. 2, the organic light emitting display device 100 may include switch configurations such as a first switch SW1 and a second switch SW2 to effectively provide a sensing operation.

The first switch SW1 may be connected with the reference voltage line RVL and providing nodes of the reference voltage Vref according to a first switching signal.

When the first switch SW1 is turned on, the reference voltage Vref is provided to the reference voltage line RVL, and when the first switch SW1 is turned off, the reference voltage Vref is not provided to the reference voltage line RVL.

The second switch SW2 may be connected with the reference voltage line RVL and the analog to digital converter ADC according to a second switching signal (i.e., a sampling signal).

When the second switch SW2 is turned on, the reference voltage line RVL and the analog to digital converter ADC are connected, and the analog to digital converter ADC can sense a voltage of the reference voltage line RVL.

Through the above-described switch configurations SW1, SW2, the organic light emitting display device 100 can enable a voltage state of the main nodes N1, N2 to be in a state needed for sensing operation, and through this, thereby enabling an efficient sensing.

The sensing data output from the analog to digital converter ADC is provided to a compensation unit 220 to compensate characteristic value deviation of the driving transistors DRTs disposed in each of the sub-pixels. The compensation unit 220 may be disposed inside or outside the timing controller 140.

The compensation unit 220 can determine a threshold voltage Vth of the driving transistor DRT disposed in each of the sub-pixels, and can determine the threshold voltage deviation between the driving transistors DRTs on the basis of the sensing data.

The compensation unit 220 calculates an amount of data compensation for each sub-pixel to compensate the determined threshold voltage deviation. The compensation unit 220 changes data of each sub-pixel on the basis of the amount of data compensation calculated by the compensation unit 220 and transmits the changed data to the source driver integrated circuits 121 of the data driver 120.

The source driver integrated circuit 121 changes the received data into a data voltage Vdata in the digital to analog converter DAC and outputs the data voltage Vdata to the data line to perform a sub-pixel compensation.

As described-above, through the sensing operation of the driving transistor DRT, the luminance deviation due to the unique characteristic value deviation (that is, a screen non-uniformity) can be improved by compensating the unique characteristic value deviation of the driving transistors DRTs.

As described-above, the unique characteristic value deviation, such as a threshold voltage of the driving transistor DRT, can be accurately sensed using the 3T1C (three transistor and one capacitor) sub-pixel structure exemplified in FIG. 2, the sensing configuration ADC, and the switch configuration SW1, SW2. On the basis of the sensing operation, the compensation for the unique characteristic value deviation of the driving transistor DRT can be achieved.

As described-above, the compensation for the unique characteristic value deviation of the driving transistor DRT is carried out by changing the digital data of the corresponding sub-pixel. Accordingly, a data voltage Vdata applied to the display panel 110 is changed as compared with before compensation.

Meanwhile, each of the plurality of source driver integrated circuits 121 included in the data driver 120 changes digital data received from the timing controller 140 into a data voltage and outputs. At this time, the available range of the voltage that can be handled by each source driver integrated circuit 121 may be limited by restrictions.

A voltage designed for the source driver integrated circuit 121 includes a gray level representation region corresponding to a gray level of a displayed image, a black gray level region representing a black gray level, a negative bios shift compensation (NBSC) region for compensating a negative shift of the driving transistor DRT from the above-described characteristic value compensation of the driving transistor DRT, a positive bios shift compensation (PBSC) region for compensating a positive shift of the driving transistor DRT, and an auxiliary available region existing between the positive bios shift compensation (PBSC) region and the negative bios shift compensation (NBSC) region.

Accordingly, the voltage designed for the source driver integrated circuit 121 may be divided into a black gray level region, a gray level representation region, and compensation regions (a negative bios shift compensation (NBSC) region, a positive bios shift compensation (PBSC) region, and an auxiliary available region).

In other words, a data voltage supplied to the display panel 110 corresponds to the gray level representation region. When a characteristic value deviation occurs in the driving transistor DRT, the data voltage of the gray level representation region is summed to a compensation value obtained in the compensation regions and supplied in a compensation data voltage form.

The compensation region may include a compensation for the unique characteristic value of the driving transistor DRT, for example, a compensation for a mobility of the driving transistor DRT, a compensation for a threshold voltage deviation of the driving transistor DRT, and a compensation for a threshold voltage shift (movement) of the driving transistor DRT. In the present disclosure, the compensation region will be described by focusing on the compensation for the threshold voltage shift of the driving transistor DRT.

The threshold voltage Vth of each of the driving transistors DRTs disposed in the sub-pixel SP of the display panel 110 have a specific distribution. As the driving time of the driving transistor DRT increases, the threshold voltages of all the driving transistors DRTs increase (positive shift). Therefore, a phenomenon in which the threshold voltage distribution is entirely shifted in a positive (+) direction occurs.

To the contrary, in case that the driving transistor DRT disposed in each of the sub-pixels does not drive, the threshold voltages of all driving transistors DRTs become decreased (negative shift). Therefore, a phenomenon in which the threshold voltage distribution is entirely shifted in a negative (−) direction occurs.

The threshold voltage shift compensation means a compensation to shift the threshold voltages of all driving transistors DRTs to a compensable range. In accordance with such a threshold voltage shift compensation, the threshold voltage distribution of all driving transistors DRTs is entirely shifted to the compensable range.

Accordingly, the entire luminance non-uniformity of the display panel 110 can be improved by compensating for a case that the threshold voltages of all driving transistors DRTs are entirely shifted due to the degradation of the driving transistor DRT.

Referring to FIG. 3 with FIG. 1, a plurality of sub-pixels SPs are arranged on the display panel 110, and four sub-pixels SP1-SP4 (that is, a red R sub-pixel, a white W sub-pixel, a blue B sub-pixel, and a green G sub-pixel) form one pixel P. In some cases, the arrangement order of the color of the sub-pixels may vary.

Accordingly, for a case in which a basic unit of a signal line connection structure is four sub-pixels SP1-SP4 requiring four data lines DL(4*n*-3), DL(4*n*-2), DL(4*n*-1), DL(4*n*), a signal connection structure and a basic pixel structure (3T1C-based 1 scan structure) can be determined.

Four data lines DL(4*n*-3), DL(4*n*-2), DL(4*n*-1), DL(4*n*) are connected to the corresponding sub-pixels SP1, SP2, SP3, SP4, respectively. The gate lines GL are connected to the corresponding sub-pixels SP1, SP2, SP3, SP4, respectively.

Each of the four sub-pixels SP1-SP4 includes a driving transistor DRT configured to receive a driving voltage EVDD and drive the organic light emitting diode, a sensor transistor SENT configured to be controlled by a scan signal, receive a reference voltage Vref, and transmit the reference voltage Vref to a first node N1 of the driving transistor DRT, a switching transistor SWT configured to be controlled by a scan signal, receive a data voltage Vdata, and transfer the data voltage Vdata to a second node N2 of the driving transistor DRT, a capacitor Cst connected between the first node N1 and the second node N2 of the driving transistor DRT or the like. Here, the scan signal is referred to as a "sensing signal" when driving the sensor transistor SENT, and referred to as a "scan signal" when driving the switching transistor SWT.

As such, each of the four sub-pixels SP1-SP4 respectively connected to the four data lines DL(4*n*-3), DL(4*n*-2), DL(4*n*-1), DL(4*n*) has a 3T1C structure including three transistors DRT, SWT, SENT and one capacitor Cst in common, and each of the sensor transistor SENT and the switching transistor SWT has a one-scan line structure that can receive the sensing signal and scan signal through one gate line GL.

As described above, the structure of each sub-pixel is referred to as "3T1C-based one scan structure".

Meanwhile, each of the four sub-pixels SP1-SP4 respectively connected to the four data lines DL(4*n*-3), DL(4*n*-2), DL(4*n*-1), DL(4*n*) may have a different signal line connection structure (signal applying method) for receiving a data voltage, a driving voltage, a reference voltage or the like, even if the number of transistors and capacitors, the number of scan signals, or the like are the same as each other. However, there exist the regularity and symmetry in the signal line connection structure between the four sub-pixels SP1-SP4 respectively connected to the four data lines DL(4*n*-3), DL(4*n*-2), DL(4*n*-1), DL(4*n*).

As described above, in a case in which the basic unit of the signal line connection structure is four sub-pixels SP1-SP4 requiring four data lines DL(4*n*-3), DL(4*n*-2), DL(4*n*-1), DL(4*n*), one reference voltage line (RVL) for supplying a reference voltage Vref may be formed and two driving voltage lines DVLs for supplying a drive voltage EVDD may be formed for four sub-pixels SP1-SP4.

In FIG. 2, since the connection structure of the driving transistor DRT, the sensor transistor SENT and the switching transistor SWT disposed in each sub-pixel has been described, a connection relationship between the reference voltage line RVL and driving voltage line DVL, as well as transistors of the sub-pixels will be briefly described as follows.

According to a formation position of the reference voltage line RVL, a sensor transistor SENT included in a sub-pixel SP2 connected to 4*n*-2th data line DL(4*n*-2) and a sub-pixel SP3 connected to 4*n*-1th data line DL(4*n*-1) is directly connected to the reference voltage line RVL, and a sensor transistor SENT included in a sub-pixel SP1 connected to 4*n*-3th data line DL(4*n*-3) and a sub-pixel SP4 connected to 4*n*th data line DL(4*n*) is connected to a connection pattern CP (dotted line) connected to the reference voltage line RVL.

Also, the driving voltage line DVL is directly connected to a third node of the driving transistor DRT in the first sub-pixel SP1 and the fourth sub-pixel SP4, and the third node of the driving transistor and the driving voltage line DVL are connected by the connection pattern CP (dotted line) in the second sub-pixie SP2 and the third sub-pixel SP3.

As such, the pixel P disposed on the display panel 110 of the organic light emitting display device 100 of the present disclosure has four sub-pixies SP1-SP4 as elements, and a red R sub-pixel SP1 and a white W sub-pixel SP2 are arranged on the left side, and a blue B sub-pixel SP3 and a green G sub-pixel SP4 are arranged on the right side around the reference voltage line RVL.

The organic light emitting display device 100 of the present disclosure, which has the above-described pixel P structure, performs a sensing operation for threshold voltage shift compensation of the driving transistor DRT disposed in each sub-pixel.

When the sensing operation of the driving transistor DRT disposed in each sub-pixel is completed, a process of reconfiguring the reference voltage Vref is performed according to the following Equation 1.

$$Vref=Vbgl+Vnbsc-Vth(\mathrm{LSL}) \quad \text{Equation 1}$$

Here, Vref means a reference voltage, Vbgl means a black gray level voltage (black gray level region), Vnbsc means a negative bios shift compensation region voltage, and Vth (LSL) means a threshold voltage at a lower specification limit.

Figure 5:
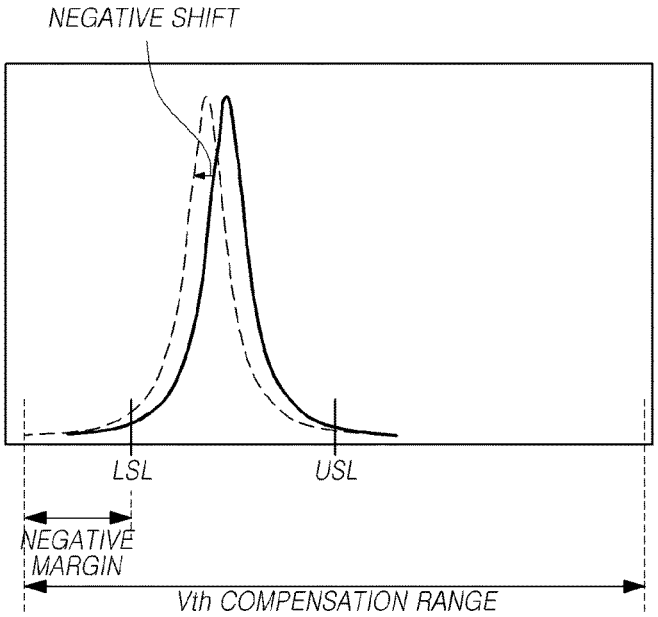
FIG. 5 is a view illustrating a threshold voltage (Vth) compensation range in case that a negative shift occurs in driving transistors of an organic light emitting display device according to the present disclosure.

Referring to FIG. 5, the threshold voltage Vth of the driving transistor DRT disposed in each sub-pixel SP on the display panel 110 shows a normal distribution curve. Here, the upper limit and lower limit are referred to as "the upper specification limit (USL)" and "lower specification limit (LSL)", respectively.

When a positive shift or negative shift occurs in the driving transistor DRT disposed in each sub-pixel SP, the normal distribution curve is entirely shifted, and due to this, the threshold voltages Vth at the upper specification limit (USL) and lower specification limit (LSL) are changed.

Like this, since the four sub-pixels SP1-SP4 of the pixel P disposed on the display panel 110 of the present disclosure share one reference voltage line RVL, the red R, white W, blue B, and green G sub-pixels SP1-SP4 are reconfigured to the identical reference voltage Vref according to Equation 1.

However, when implementing white W light for reducing the power consumption by lowering the drive current supplied to the four sub-pixels, the white W sub-pixel and another two sub-pixels are driven and one sub-pixel of the four sub-pixels is not driven.

Similarly, if a non-driven sub-pixel exists in a pixel P, a threshold voltage shift phenomenon in which the threshold voltage becomes different from that of the driven sub-pixels occurs. For example, a positive shift occurs in the driven sub-pixel and a negative shift occurs in the non-driven sub-pixel.

Accordingly, in the pixel structure of the organic light emitting display device 100 of the present disclosure, the reference voltage line RVL is commonly connected to the four sub-pixels SP1-SP4, therefore, when any one reference voltage Vref is configured, a proper compensation for the non-driven sub-pixel is not performed.

Figure 4:
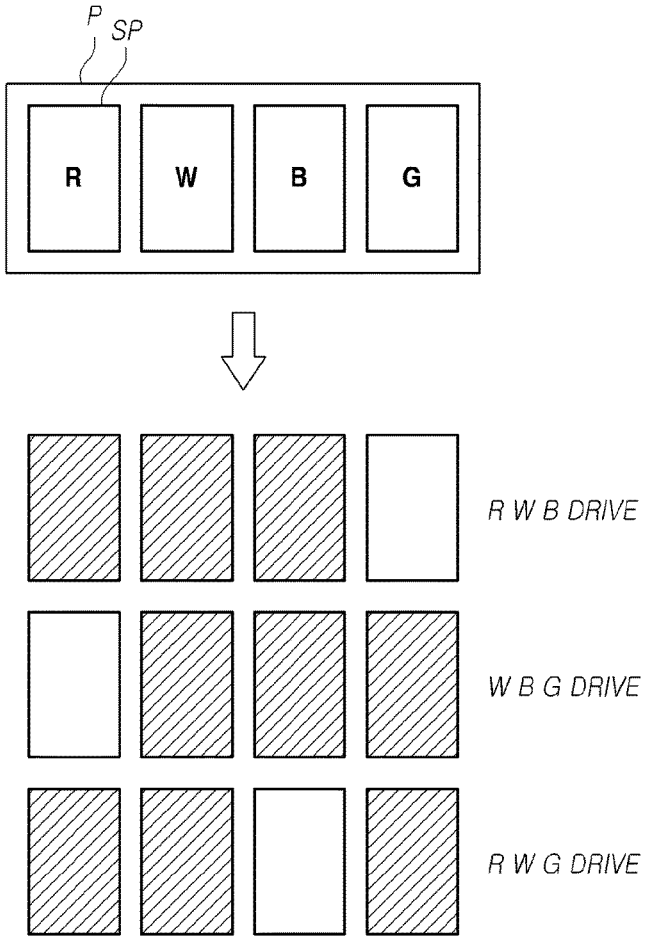
FIG. 4 is an exemplary view illustrating a white (W) color implementing method of an organic light emitting display device according to the present disclosure.
Figure 6:
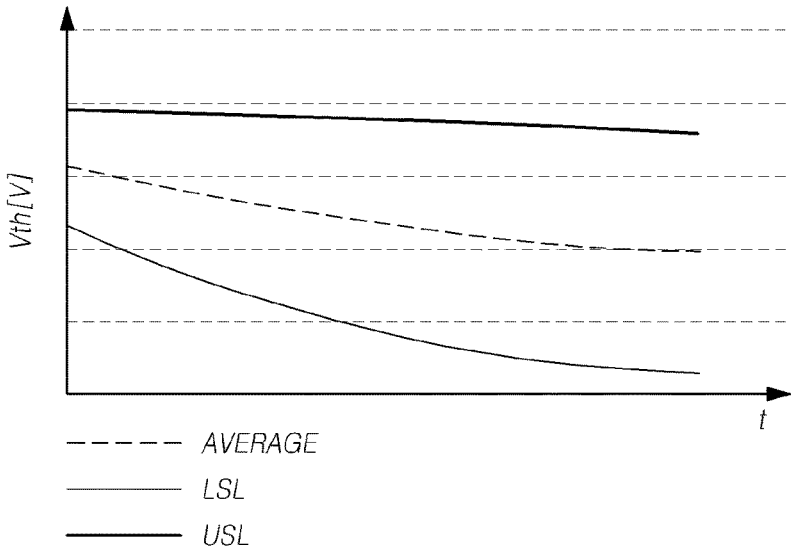
FIG. 6 is a graph illustrating a threshold voltage shift of a non-driven sub-pixel of an organic light emitting display device according to the present disclosure.

FIG. 4 is an exemplary view illustrating a white W light implementation method of an organic light emitting display device according to the present disclosure. FIG. 5 is a view illustrating a threshold voltage Vth compensation range in a case in which a negative shift occurs in driving transistors of an organic light emitting display device according to the present disclosure. FIG. 6 is a graph illustrating a threshold voltage shift of non-driven sub-pixel of an organic light emitting display device according to the present disclosure.

Referring to FIGS. 4 to 6, the pixel P arranged on the display panel 110 of the present disclosure is composed of four sub-pixels SP, and the sub-pixels have an order of a red R sub-pixel, a white W sub-pixel, a blue B sub-pixel, and a green G sub-pixel.

However, it is not limited thereto, and each sub-pixel may be arranged in various orders.

The organic light emitting display device 100 having the pixel P structure of the present disclosure, to implement white W light, drives only the white W sub-pixel, red R sub-pixel, and blue B sub-pixel (hatched sub-pixel) and does not drive the green G sub-pixel (non-hatched sub-pixel), or drives the white W sub-pixel, green G sub-pixel, and blue B sub-pixel (hatched sub-pixels) and does not drive the red R sub-pixel (non-hatched sub-pixel), or drives the white W sub-pixel, red R sub-pixel and green G sub-pixel (hatched sub-pixel) and does not drive the blue B sub-pixel (non-hatched sub-pixel). However, in order to implement white W light, the organic light emitting display device 100 may drive only white W sub-pixel and not drive the remaining three sub-pixels, or may not drive two sub-pixels of the red R, blue B, and green G sub-pixels.

For example, if the white W light is implemented by driving the white W, red R and blue B sub-pixels except the green G sub-pixel, as illustrated in FIG. 5, a positive shift occurs in the driven sub-pixels, and a negative shift occurs in the non-driven sub-pixel.

In case that any one sub-pixel is not driven to implement the above-described white W light, the phenomenon may always occur in the non-driven sub-pixel in the same manner. Accordingly, an effect to improve the luminance non-uniformity by expanding a negative bios shift compensation region margin for the non-driven sub-pixel, in a case of the non-driven sub-pixel, may be applied to any sub-pixels of the red R, blue B, and green G sub-pixies in the same manner.

If a sub-pixel generating green G light is not driven when implementing the white W light, a negative shift beyond a margin of a negative bios shift compensation (NBSC) range from a voltage range configured for the source driver integrated circuits occurs.

In other words, if the negative shift occurred in the driving transistor DRT exceeds the negative bios shift compensation (NBSC) region, the compensation is made within the negative bios shift compensation (NBSC) range, and thus, a proper compensation is not achieved. Even if the compensation is obtained, a luminance rising failure occurs.

As described above, the same phenomenon occurs even if the non-driven sub-pixel SP is the red R sub-pixel or blue B sub-pixel.

Referring to FIG. 6, threshold voltages Vth of the driving transistors DRTs included in the sub-pixel are distributed in a certain normal distribution curve shape, and it can be seen that an average, an upper specific limit (USL), and a lower specification limit (LSL) are gradually lowered according to the time.

Especially, the lower specification limit (LSL) related to the compensation for the negative shift is continuously lowered according to the time. If the lower specification limit (LSL) is continuously lowered due to non-driving by the above-described Equation 1, the lower specification limit (LSL) exceeds the voltage range of the negative bios shift compensation region. Accordingly, the reconfigured reference voltage Vref becomes a voltage to which the characteristic value deviation of the driving transistor DRT is not properly reflected, and causes a luminance imbalance phenomenon such as luminance increasing by the compensation.

$$Vref=Vbgl+Vnc-Vth(\mathrm{LSL}) \quad \text{Equation 1}$$

Here, Vref means a reference voltage, Vbgl means a black gray level voltage, Vnc means a negative bios shift compensation region voltage, and Vth (LSL) means a threshold voltage at a lower specification limit (LSL).

The reconfigured reference voltage Vref is affected by a difference between the negative bios shift compensation region voltage and the threshold voltage at lower specification limit Vth (LSL).

That is, the voltage of the negative bios shift compensation region is configured to a certain range (generally, 1 V), and if the lower specification limit (LSL) is shifted over 1 V due to the negative shift of the non-driven sub-pixel, the negative bios shift compensation region voltage and Vth (LSL) are generated as negative (−) values.

Accordingly, the voltage margin of the negative bios shift compensation region cannot sufficiently cover the shifted threshold voltage Vth (LSL), and thus, the non-driven sub-pixel cannot be compensated by the reconfigured reference voltage Vref.

Figure 7:
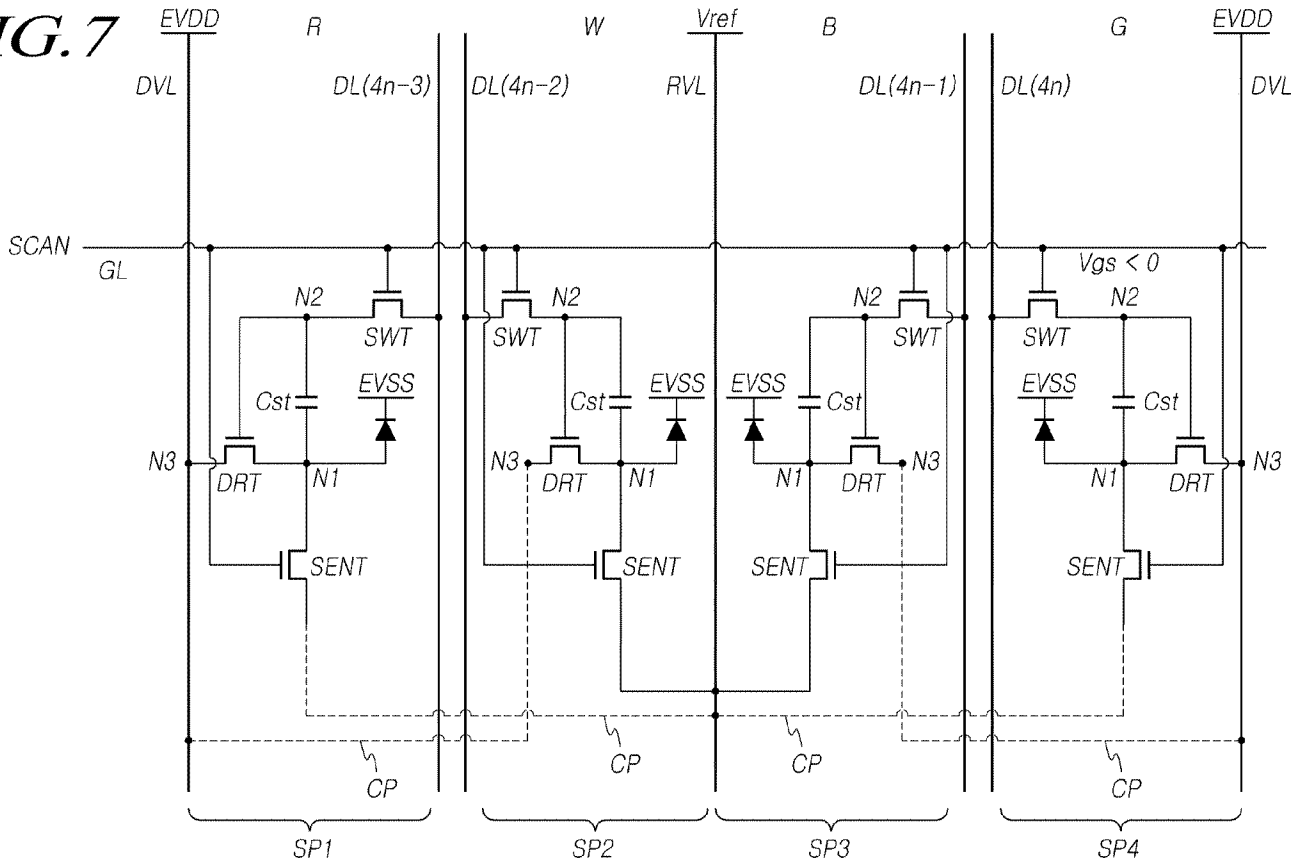
FIG. 7 is a view illustrating threshold voltage shifts of a non-driven sub-pixel and driven sub-pixel from sub-pixel circuits of an organic light emitting display device according to the present disclosure.
Figure 8:
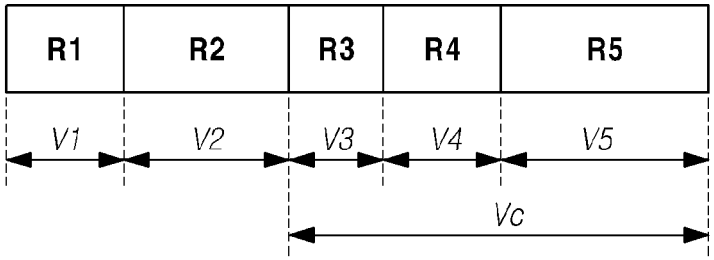
FIG. 8 is a view illustrating a range of voltages designed for a source driver integrated circuit of an organic light emitting display device according to the present disclosure.
Figure 9:
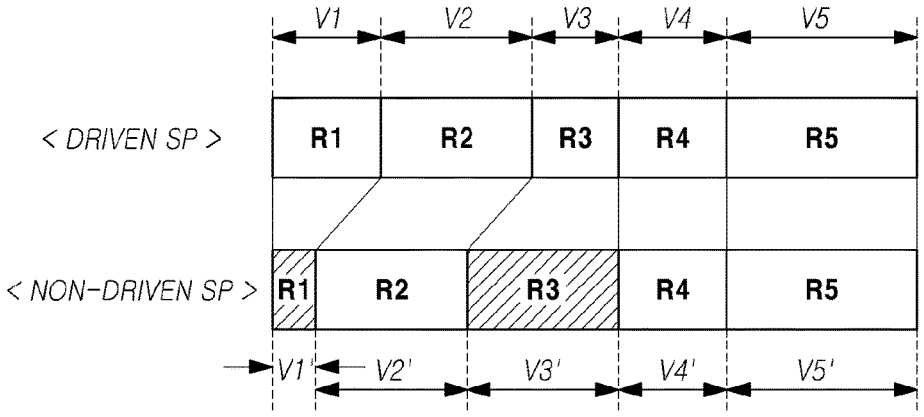
FIG. 9 is a view illustrating voltages designed for a source driver integrated circuit for each driven sub-pixel and non-driven sub-pixel of an organic light emitting display device according to the present disclosure.

FIG. 7 is a view illustrating a threshold voltage shift of a non-driven sub-pixel and a driven sub-pixel from sub-pixels circuit of an organic light emitting display device according to the present disclosure. FIG. 8 is a view illustrating a range of voltages designed for a source driver integrated circuit of an organic light emitting display device according to the present disclosure. FIG. 9 is a view illustrating voltages designed for the source driver integrated circuit for each driven sub-pixel and non-driven sub-pixel of an organic light emitting display device according to the present disclosure.

Referring to FIGS. 7 to 9, in the organic light emitting display device 100, red R, white W, blue B, and green G sub-pixels SP1-SP4 form one pixel P, and the red R, white W, blue B, and green G sub-pixels SP1-SP4 are connected to be symmetric to each other around a reference voltage line RVL providing a reference voltage Vref, as illustrated in FIG. 7.

Especially, in case that the white W, red R and blue B sub-pixels SP1-SP3 are driven and the green G sub-pixel SP4 is not driven to implement white W light, a positive shift occurs in the driving transistors DRTs disposed in the white W, red R and blue B sub-pixels SP1-SP3, and a negative shift occurs in the driving transistor DRT disposed in the green G sub-pixel SP4.

For example, when assuming that a data voltage of implementing white W light as 7 V, a data voltage Vdata of representing a black gray level as 0.5 V, and a reference voltage as 1.5 V or greater, Vgs (VN2N1) is represented as Vdata-Vref.

Here, in case of the white W, red R and blue B sub-pixels SP1-SP3, Vgs (VN2N1) becomes greater than 0 (zero) (that is, Vgs (VN2N1)>0) by a positive shift due to driving of the white W, red R and blue B sub-pixels SP1-SP3, and in case of the green G sub-pixel SP4, Vgs (VN2N1) becomes less than 0 (zero) (that is Vgs (VN2N1)<0) by a negative shift due to non-driving of the green G sub-pixel SP4.

Accordingly, it is preferred to sufficiently ensure a margin of a negative bios shift compensation region in order to properly compensate the negative shift of the non-driven sub-pixel SP4. However, if the negative bios shift compensation region is expanded, a problem in which a voltage margin of a black gray level region or a positive bios shift compensation region is reduced occurs.

If the margin of the positive bios shift compensation region is reduced, when compensating for a positive shift of the driving transistor DRT, a problem due to the lack of the voltage margin of the negative bios shift compensation region occurs in the same manner because of the excess of the compensation range for the positive shift of the threshold voltage Vth.

In addition, there is a method to dispose a separate reference voltage line RVL for the non-driven sub-pixel. However, if the reference voltage line RVL is added, there is a problem in that an aperture ratio decreases.

Accordingly, since the white W, red R, blue B, and green G sub-pixels SP1-SP4 are commonly connected to the reference voltage line RVL, and the reference voltage Vref is used as a common reference voltage, the voltage of the source driver integrated circuit needs to be designed so that the reconfigured reference voltage Vref compensates both of the positive shift generated in the driven sub-pixels and the negative shift generated in the non-driven sub-pixel.

Referring to FIG. 8, a voltage designed for the source driver integrated circuit 121 includes a gray level representation region R2 corresponding to a gray level representation voltage range, a black gray level region R1 as a voltage region representing a black gray level, a negative bios shift compensation region R3 as a voltage region for compensating a negative shift of the driving transistor DRT, a positive bios shift compensation region R5 as a voltage Region for compensating a positive shift of the driving transistor DRT, and an auxiliary available region R4 disposed between the positive bios shift compensation region R5 and the negative bios shift compensation region R3.

A boundary of the auxiliary available region R4 and the negative bios shift compensation region R3 may be a threshold voltage Vth of the lower specification limit (LSL).

For example, the voltage designed for the source driver integrated circuit 121 of FIG. 8 may be configured to 1 V for the black gray level region R1, 1 V for the negative bios shift compensation region R3, 1.6 V for the auxiliary available region R4, and 3.25 V for the positive bios shift compensation region R5.

As described above, since one of the sub-pixels is not driven when implementing white W light, one of the red R sub-pixel, blue B sub-pixel, or green G sub-pixel becomes a non-driven sub-pixel.

In other words, when implementing white W light using a pixel P composed of the white W, red R, blue B, and green G sub-pixels, there exist driven sub-pixels and a non-driven sub-pixel in the sub-pixels.

Accordingly, the voltage to be designed for the source driver integrated circuit 121 illustrated in FIG. 8 needs to be individually configured for each of the driven sub-pixel and non-driven sub-pixel.

Referring to FIG. 9, a voltage of the black gray level region R1 of the driven sub-pixel SP is configured to V1, a voltage of the gray level representation region R2 is configured to V2, a voltage of the negative bios shift compensation region R3 is configured to V3, a voltage of the auxiliary available region R4 is configured to V4, and a voltage of the positive bios shift compensation region R5 is configured to V5.

Also, for the non-driven sub-pixel, a voltage of the black gray level region R1 is configured to V1', a voltage of the gray level representation region R2 is configured to V2', a voltage of the negative bios shift compensation region R3 is configured to V3', a voltage of the auxiliary available region R4 is configured to V4', and a voltage of the positive bios shift compensation region R5 is configured to V5'.

At this time, it is possible to ensure a margin of the negative bios shift compensation region for the non-driven sub-pixel without the need to set a reference voltage Vref individually, by making the sum of the voltages of the black gray level region R1 and the negative bios shift compensation region R3 from the voltages of the source driver integrated circuit 121 of the present disclosure be identical for the driven sub-pixels and non-driven sub-pixel.

That is, the sum of R1 and R3 of the driven sub-pixels and the sum of R1' and R2' of the non-driven sub-pixel have the same value.

As a result, according to the organic light emitting display device 100 of the present disclosure, the negative shift generated in the non-driven sub-pixel can be compensated by reducing the voltage of the black gray level region R1 to R1' for the non-driven sub-pixel, and expanding the voltage range of the negative bios shift compensation region R3 by the reduced voltage.

In other words, according to the present disclosure, when a non-driven sub-pixel exists due to white W light implementation, it is possible to compensate the negative shift without increasing the number of the reference voltage line RVL by reducing the voltage margin of the black gray level region R1 of the driven sub-pixel SP and increasing the voltage margin of the negative bios shift compensation region R3 for the corresponding non-driven sub-pixel.

For example, the voltage V1 of the black gray level region R1 is configured to 1 V for the driven sub-pixel, but to 0.5 V for the non-driven sub-pixel, and the voltage V3 of the negative bios shift compensation region R3 is configured to 1 V for the driven sub-pixel, but to 1.5 V for the non-driven sub-pixel, thereby expanding a margin.

Accordingly, even if the reference voltage Vref is reconfigured by Equation 1, since the voltage margin of the negative bios shift compensation region is increased from 1 V to 1.5 V, even though an excessive negative shift occurs in the non-driven sub-pixel, the reference voltage Vref can be reconfigured in consideration of the excessive negative shift.

In other words, the reference voltage for the non-driven sub-pixel needs to be reconfigured to be separately increased unlike the driven sub-pixel, according to the present disclosure, the luminance failure that occurred in the non-driven sub-pixel can be improved without changing the reference voltage Vref by expanding the voltage margin of the negative bios shift compensation region.

In addition, according to the present disclosure, there is an effect to compensate a negative shift without reducing the voltage margin of the positive bios shift compensation region because the voltage margin of the negative bios shift compensation region is expanded by controlling the black gray level region and negative bios shift compensation region.

In addition, according to the present disclosure, even if the reference voltage Vref supplied to the reference voltage line RVL that is commonly connected to four sub-pixels is commonly configured by Equation 1, there is an effect to compensate the negative shift of the threshold voltage Vth of the driving transistor DRT by expanding the voltage margin of the negative bios shift compensation region.

Figure 10:
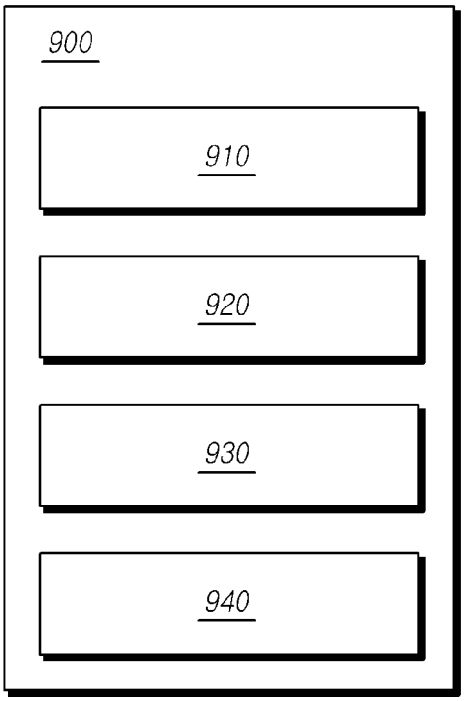
FIG. 10 is a block diagram illustrating a compensation margin controller according to the present disclosure.
Figure 11:
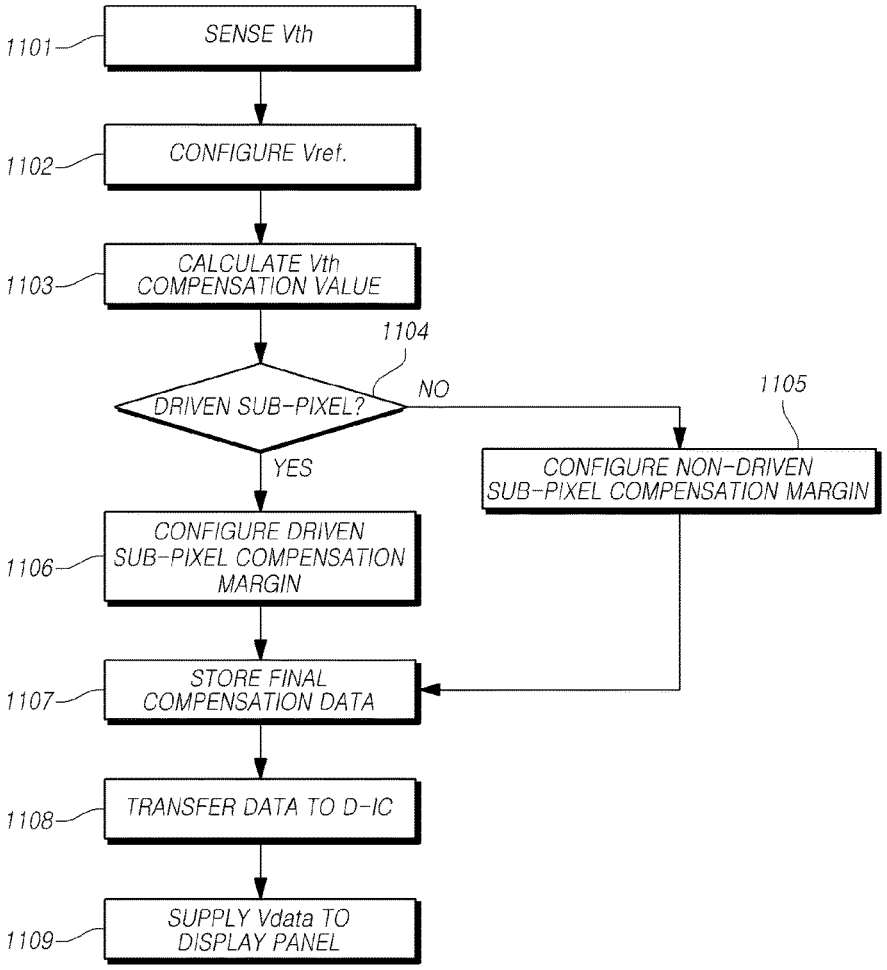
FIG. 11 is a flow chart illustrating a driving method of an organic light emitting display device according to the present disclosure.

FIG. 10 is a block diagram illustrating a compensation margin controller according to the present disclosure. FIG. 11 is a flow chart illustrating a driving method of an organic light emitting display device according to the present disclosure.

Referring to FIGS. 10 and 11, a timing controller 140 of the organic light emitting display device 100 includes a compensation margin controller 900 including a sub-pixel drive checking unit 910 configured to check whether the sub-pixel is driven or not, a non-driven sub-pixel compensation margin control unit 920 configured to control a compensation region margin for the non-driven sub-pixel, a driven sub-pixel compensation margin control unit 930 configured to control a compensation region margin for the driven sub-pixel, and a command transfer unit 940 configured to transfer a compensation region margin information of the driven sub-pixel and non-driven sub-pixel.

As described with reference to FIG. 2, when a sensing value is obtained by a sensing operation, and a threshold voltage Vth compensation value is calculated by the compensation unit 220 using the obtained sensing value, the timing controller 140 proceeds with a compensation of a data voltage on the basis of the compensation value calculated by the compensation unit 220.

At this time, in the present disclosure, the sub-pixel drive checking unit 910 checks whether the threshold voltage Vth compensation value is for the driving transistor DRT of the driven sub-pixel or for the driving transistor DRT of the non-driven sub-pixel, on the basis of the threshold voltage Vth compensation value supplied from the compensation unit 220.

In case that the threshold voltage Vth compensation value is for the non-driven sub-pixel, by the non-driven sub-pixel compensation margin control unit 920, the driving voltage of the source driver integrated circuit 121 is configured so that the voltage of the black gray level region R1 is configured to V1', a voltage of the gray level representation region R2 is configured to V2', a voltage of the negative bios shift compensation region R3 is configured to V3', a voltage of the auxiliary available region R4 is configured to V4', and a voltage of the positive bios shift compensation region R5 is configured to V5', as shown in FIG. 9.

In addition, in case that the threshold voltage Vth compensation value is for the driven sub-pixel, by the driven sub-pixel compensation margin control unit 930, the driving voltage of the source driver integrated circuit 121 is configured so that the voltage of the black gray level region R1 is configured to V1, a voltage of the gray level representation region R2 is configured to V2, a voltage of the negative bios shift compensation region R3 is configured to V3, a voltage of the auxiliary available region R4 is configured to V4, and a voltage of the positive bios shift compensation region R5 is configured to V5, as shown in FIG. 9.

As describe above, when the compensation margins for the non-driven sub-pixel and driven sub-pixel are configured, compensation region margin information of the driven sub-pixel and non-driven sub-pixel is transferred to the data compensation unit of the timing controller 140 through the command transfer unit 940.

The timing controller 140 performs a data compensation on the basis of the transferred voltage driving value, stores the compensated data, and supplies the compensated data to the display panel through the source driver integrated circuit 121.

A method of driving the organic light emitting display device 100 of the present disclosure will be described with the compensation margin control unit 900 as follows.

Firstly, a sensing operation for each of the sub-pixels arranged on the display panel 110 is performed (operation 1101). There is various information obtained by the sensing operation, but hereinafter a sensing operation for the threshold voltage Vth of the driving transistor DRT arranged in the sub-pixel will be mainly described.

As describe above, when the threshold voltage Vth sensing for each sub-pixel is completed, a reference voltage Vref commonly provided to the pixels P is configured, and a compensation value for a threshold voltage compensation is calculated (operations 1102, 1103).

Then, whether the sub-pixel is a driven sub-pixel or non-driven sub-pixel from sub-pixels included in each pixel P, and if the calculated threshold voltage Vth compensation value is for the driven sub-pixel, a compensation margin for the driven sub-pixel is configured, as shown in FIG. 9 (operations 1104, 1106).

In addition, if the calculated threshold voltage Vth compensation value is for the non-driven sub-pixel, a compensation margin for the non-driven sub-pixel is configured to a voltage driving of the non-driven sub-pixel of FIG. 9 (operation steps 1104, 1105).

As describe above, the timing controller 140 calculates and stores a final compensation data voltage on the basis of the configured compensation margins of the driven sub-pixel and non-driven sub-pixel (operation step 1107).

After transferring the compensation data voltage to the source driver integrated circuit, the source driver integrated circuit supplies the compensated data voltage to the display panel and enables an image to be displayed (operation steps 1108, 1109).

Like this, a compensation margin control device, an organic light emitting display device and a method of driving the same according to the present disclosure have an effect to effectively perform the compensation related to the unique characteristic value of the driving transistor, thereby improving the image quality.

Also, according to a compensation margin control device, an organic light emitting display device and a method of driving the same according to the present disclosure, there is an effect to improve the image quality by ensuring a margin of the negative bios shift compensation region of the driving transistor of the non-driven sub-pixel, without affecting the gray level representation and positive compensation.

In addition, according to a compensation margin control apparatus, an organic light emitting display device and a method of driving the same according to the present disclosure, though the threshold voltage shift phenomenon of the driving transistor occurs, there is an effect to improve the image quality by allowing a compensation related to the unique characteristic value of the driving transistor to be made.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. An organic light emitting display device comprising:

a display panel on which a plurality of data lines and a plurality of gate lines are arranged and a plurality of sub-pixels are arranged in a matrix form;

a data driver driving the data lines;

a gate driver driving the gate lines; and a timing controller controlling the data driver and the gate driver, wherein each of the sub-pixels comprises an organic light emitting diode, a driving transistor, a first transistor, a second transistor, and a capacitor, each of the sub-pixels constitutes a pixel with four sub-pixels, wherein a white sub-pixel or more of three sub-pixels is driven and at least one of the three sub-pixels is not driven when a white color driving scheme is implemented, and the data driver has a source driver integrated circuit that supplies a different voltage to the driven white sub-pixel or more and the non-driven at least one sub-pixel when the pixel is driven with a driving voltage to represent a color and maintains a same reference voltage for the driven white sub-pixel or more and the at least one non-driven sub-pixel, wherein the driving voltage includes a compensation region voltage to compensate for a shift in a threshold voltage of the driving transistor, and the compensation region voltage has a different voltage range for the driven the white sub-pixel or more and the non-driven at least one sub-pixel, wherein the driving voltage of the source driver integrated circuit comprises a black gray level region voltage for representing a black gray level of a displayed image and the compensation region voltage comprises a negative bios shift compensation region voltage for compensating for a negative shift in the threshold voltage of the driving transistor, wherein the negative bios shift compensation region voltage is increased for the non-driven at least one sub-pixel by reducing the black gray level region voltage for a corresponding driven white sub-pixel or more.

2. The organic light emitting display device of claim 1, wherein the driving transistor comprises a first node connected to a first electrode of the organic light emitting diode, a second node corresponding to a gate node, and a third node connected to a driving voltage line, the first transistor is electrically connected between the first node of the driving transistor and a reference voltage line, the second transistor is electrically connected between the second node of the driving transistor and the data line, and the capacitor is connected between the first node and second node of the driving transistor.

3. The organic light emitting display device of claim 1, wherein the driving transistor of the driven white sub-pixel or more sub-pixel has the threshold voltage shifted in a positive direction, and the driving transistor of the non-driven at least one sub-pixel has a threshold voltage shifted in a negative direction.

4. The organic light emitting display device of claim 1, wherein the driving voltage of the source driver integrated circuit further comprises a gray level representation region voltage corresponding to a gray level, wherein the compensation region voltage comprises a positive bios shift compensation region voltage for compensating for a positive shift in the threshold voltage of the driving transistor, and an auxiliary available region voltage existing between the positive bios shift compensation region voltage and the negative bios shift compensation region voltage.

5. The organic light emitting display device of claim 4, wherein a sum of the voltage range of the black gray level region voltage and the voltage range of the negative bios shift compensation region voltage of the driven white sub-pixel or more sub-pixel is the same as a sum of the voltage range of the black gray level region voltage and the voltage range of the negative bios shift compensation region voltage of the non-driven at least one sub-pixel.

6. The organic light emitting display device of claim 4, wherein the voltage range of the negative bios shift compensation region voltage of the non-driven at least one sub-pixel is greater than the voltage range of the negative bios shift compensation region voltage of the driven white sub-pixel or more sub-pixel.

7. The organic light emitting display device of claim 1, wherein the pixel is composed of a red R sub-pixel, white W sub-pixel, blue B sub-pixel, and green G sub-pixel, and the non-driven at least one sub-pixel is one of the sub-pixels among the red R sub-pixel, blue B sub-pixel, and green G sub-pixel when the pixel represents white color.

8. A method of driving an organic light emitting display device in which a plurality of sub-pixels includes a white sub-pixel or more of the four sub-pixels to be driven and at least one of three sub-pixels not to be driven when a white color driving scheme is implemented, and includes an organic light emitting diode, a driving transistor having a first node connected to a first electrode of the organic light emitting diode, a second node corresponding to a gate node, and a third node electrically connected to a driving voltage line, a first transistor connected between the first node of the driving transistor and a reference voltage line, a second transistor electrically connected between the second node of the driving transistor and a data line, and a storage capacitor electrically connected between the first node and second node of the driving transistor are arranged in a matrix form, the method comprising:

sensing a threshold voltage shift of the driving transistors in the plurality of sub-pixels;

obtaining a sensing value in the sensing of the threshold voltage shift, and determining whether each sensing value is a sensing value of the driven white sub-pixel or more sub-pixels or a sensing value of the non-driven at least one sub-pixel;

configuring a first voltage driving value for the driven white sub-pixel or more sub-pixel and a second voltage driving value for the non-driven at least one sub-pixel; and performing data compensation on based on the first and second voltage driving values by maintaining a same reference voltage for the driven white sub-pixel or more sub-pixel and non-driven at least one sub-pixel, wherein the first and second voltage driving values include a compensation region voltage to compensate for a shift in a threshold voltage of the driving transistor, and the compensation region voltage has a different voltage driving values for the first and second voltage driving values, wherein the driving voltage of the source driver integrated circuit comprises a black gray level region voltage for representing a black gray level of a displayed image and the compensation region voltage comprises a negative bios shift compensation region voltage for compensating for a negative shift in the threshold voltage of the driving transistor, wherein the negative bios shift compensation region voltage is increased for the non-driven at least one sub-pixel by reducing the black gray level region voltage for a corresponding driven white sub-pixel or more.

9. The method of claim 8, wherein the first and second voltage driving values further comprises a gray level representation region voltage corresponding to a gray level, wherein the compensation region voltages comprise a voltage of a positive bios shift compensation region voltage compensating for a positive shift in the threshold voltage of the driving transistor, and an auxiliary available region voltage existing between the positive bios shift compensation region voltage and the negative bios shift compensation region voltage.

10. The method of claim 9, wherein a sum of the voltage of the black gray level region voltage and the voltage range of the negative bios shift compensation region voltage of the first voltage driving value is the same as a sum of the voltage range of the black gray level region voltage and the voltage range of the negative bios shift compensation region voltage of the second voltage driving value.

11. The method of claim 9, wherein the voltage range of the negative bios shift compensation region voltage of the second voltage driving value is greater than the voltage range of the negative bios shift compensation region voltage of the first voltage driving value.

12. A method of driving an organic light emitting display device having a display panel to display an image at a plurality of pixels, where each pixel has a plurality of sub-pixels, and each sub-pixel has an organic light emitting diode and a driving transistor, the method comprising:

sensing a threshold voltage of the driving transistor in the sub-pixels including a white sub-pixel or more of the plurality sub-pixels to be driven and at least one of the plurality sub-pixels not to be driven when a white color driving scheme is implemented;

determining a reference voltage to be supplied to each pixel;

calculating a compensation value to compensate the threshold voltage;

selecting the sub-pixels to represent color and not represent color by applying a driving voltage;

determining a margin of a compensation region voltage to compensate for a shift in the threshold voltage of the driving transistors of both the white sub-pixel or more sub-pixel and the non-driven at least one sub-pixel;

storing a compensated data voltage at a timing controller based on the compensation value and the margin of the compensation region voltage for the white sub-pixel or more sub-pixel and the non-driven at least one sub-pixel; and transferring the compensated data voltage to a source driver integrated circuit to supply the compensated data voltage to the display panel and maintaining a same reference voltage same for the white sub-pixel or more and non-driven at least one sub-pixels wherein the driving voltage of the source driver integrated circuit comprises a black gray level region voltage for representing a black gray level of a displayed image and the compensation region voltage comprises a negative bios shift compensation region voltage for compensating for a negative shift in the threshold voltage of the driving transistor, wherein the negative bios shift compensation region voltage is increased for the non-driven at least one sub-pixel by reducing the black gray level region voltage for a corresponding driven white sub-pixel or more.

13. The method of claim 12, wherein the driving transistor of the white sub-pixel or more sub-pixel has the threshold voltage shifted in a positive direction and the driving transistor of the non-driven at least one sub-pixel has the threshold voltage shifted in a negative direction.

14. The method of claim 12, wherein the pixel includes a red sub-pixel, a white sub-pixel, a blue sub-pixel, and a green sub-pixel, and the non-driven at least one sub-pixel is one of the sub-pixels among the red sub-pixel, blue sub-pixel, and green sub-pixel when the pixel represents white color.

* * * * *